United States Patent [19]

Lübbers

[11] Patent Number: 4,754,704

[45] Date of Patent: Jul. 5, 1988

[54] PROPELLANT CHARGE FOR THE REDUCTION OF BASE EDDYING

[75] Inventor: Willi Lübbers, Trittau, Fed. Rep. of Germany

[73] Assignee: Nico-Pyrotechnik Hanns-Jürgen Diederichs GmbH & Co. KG, Trittau, Fed. Rep. of Germany

[21] Appl. No.: 939,480

[22] PCT Filed: Mar. 25, 1986

[86] PCT No.: PCT/EP86/00095

§ 371 Date: Nov. 21, 1986

§ 102(e) Date: Nov. 21, 1986

[87] PCT Pub. No.: WO86/05581

PCT Pub. Date: Sep. 25, 1986

[30] Foreign Application Priority Data

Mar. 22, 1985 [DE] Fed. Rep. of Germany ..... 3510446

[51] Int. Cl.[4] ..... C06C 5/06; C06C 5/00; F42B 13/12

[52] U.S. Cl. ..... 102/275.11; 102/275.6; 102/204; 102/202; 102/322; 102/490

[58] Field of Search ..... 102/490, 501, 513, 202, 102/283, 285, 286, 287, 288, 202.14, 275.11, 275.12, 275.6, 204, 322; 86/20.14

[56] References Cited

U.S. PATENT DOCUMENTS

| | | | |
|---|---|---|---|
| 2,613,604 | 10/1952 | Pyle | 102/490 |
| 2,921,521 | 1/1960 | Lattaye | 102/39 |
| 3,407,736 | 10/1968 | Beuschel | 102/99 |
| 3,687,080 | 8/1972 | Hofmann | 102/285 |
| 3,710,723 | 1/1973 | Muller et al. | 102/513 |
| 3,902,424 | 9/1975 | Dietsch et al. | 102/513 |
| 4,148,187 | 4/1979 | Younkin | 102/287 |
| 4,170,941 | 10/1979 | Reichard et al. | 102/202 |
| 4,249,466 | 2/1981 | Rossmann et al. | 102/513 |
| 4,495,866 | 1/1985 | Brede et al. | 102/202 |
| 4,574,700 | 3/1986 | Lewis | 102/287 |

FOREIGN PATENT DOCUMENTS

| | | |
|---|---|---|
| 715614 | 12/1931 | France . |
| 1508558 | 1/1968 | France . |
| 1507865 | 4/1978 | United Kingdom . |
| 2131926 | 6/1984 | United Kingdom . |

*Primary Examiner*—Peter A. Nelson
*Assistant Examiner*—Howard J. Locker
*Attorney, Agent, or Firm*—Spencer & Frank

[57] ABSTRACT

A propellant charge for the reduction of base eddying or drag of a shell 12 with a centrally disposed ignition conduit and an ignition device for the charge disposed in the conduit. To improve the ignition readiness of the propellant charge, the inner surface of the propellant charge, which surrounds the ignition conduit, is formed so that it conically narrows in the aft direction. Additionally, the inner surface of the propellant charge may be provided with stepped sections. Finally, the ignition conduits disposed in the housing of the ignition device may be disposed at an angle relative to the longitudinal axis of the propellant charge so that they face the inner surface thereof.

11 Claims, 1 Drawing Sheet

PROPELLANT CHARGE FOR THE REDUCTION OF BASE EDDYING

BACKGROUND OF THE INVENTION

The invention relates to a propellant charge for the reduction of base eddying or drag of an artillery shell and which has a centrally disposed ignition conduit and an ignition device for the charge disposed in the conduit.

Such propellant charges diminish, by pyrotechnical gas production, the base eddying, drag or resistance occurring in a shell in flight and thereby increase the range of the shell. For example, an artillery shell of 155 mm caliber can, with the aid of such a propellant charge (base bleed effect), cover distances of more than 30 km. The propellant charges have ignition means which are activated by hot propellant charge gases during firing of the shell and which in turn ignite the base bleed propellant charge. It was noted in connection with known propellant charges that this ignition process does not occur with a sufficiently high degree of accuracy.

A propellant charge is already known from German patent application DE P No. 34 37 250.4, corresponding to DEOS No. 34 37 250, published Apr. 4th, 1986, in which the wall of the propellant charge which bounds the ignition conduit shows an ignition-enhancing layer or a roughened structure having an increased surface in order to improve the ignition process.

SUMMARY OF THE INVENTION

It is an object of the invention to provide an alternate and further improved solution for an assured control of the ignition problem.

The above object is achieved according to the present invention by a propellant charge for the reduction of the base eddying or drag of a projecticle or shell wherein the charge is of the type having a centrally disposed ignition conduit extending axially therethrough and is provided with an ignition means for the charge which is disposed adjacent the front end of the ignition conduit; and wherein the inner surface of the propellant charge defining the ignition conduit conically narrows in the aft direction of the propelling charge.

According to further features of the invention, the conically narrowed inner surface of the propelling charge may additionally be provided with stepped sections and/or the ignition openings provided in the housing for the ignition means may be oriented at an angle to the longitudinal axis of the propellant charge so that they face the inner surface of the propellant charge.

BRIEF DESCRIPTION OF THE DRAWINGS

The invention is further explained below with reference to the drawings wherein.

DETAILED DESCRIPTION OF THE PREFERRED EMBODIMENTS

Figure 1:
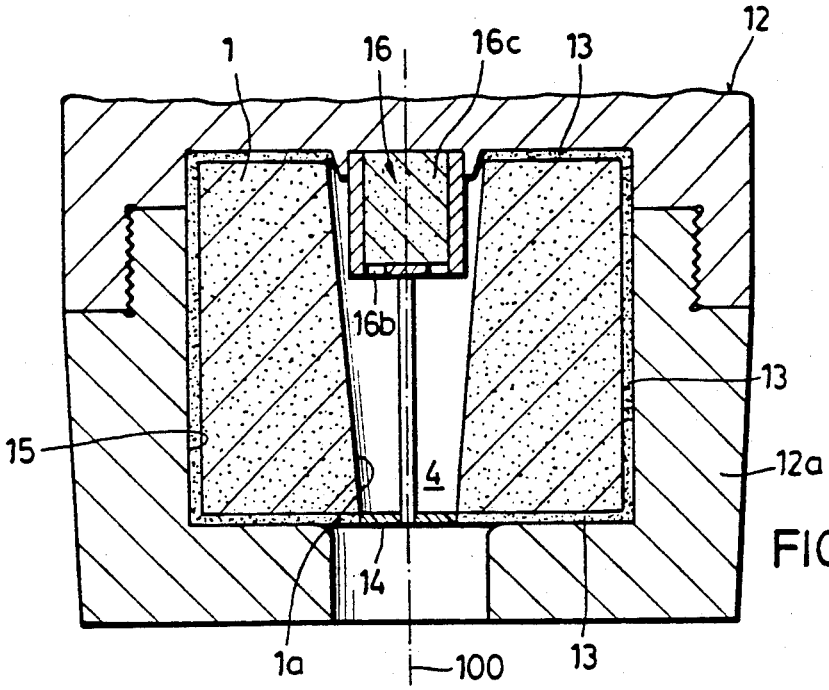
FIG. 1 shows the aft section of a shell in longitudinal section with a first exemplary embodiment of the invention.

FIG. 1 shows the aft end of an artillery shell 12 which can be fired from weapons having gun barrels, such as field howitzers, self-propelled howitzers and mortars.

The shell 12 includes a propellant charge 1 for the reduction of base eddying disposed in a screw-on base element 12*a* with a hollow space serving as a combustion chamber 15. This propellant charge 1 includes an ignition conduit 4 which is disposed central-axially, and is closed, for reasons of safe handling, for the time being by a rupture disk 14 which, when firing the shell 12 from a weapon barrel (not shown), is destroyed by the resultant hot propellant charge gases. Disposed at the front end of the ignition conduit 4 is an ignition means or device 16, including a housing 16*a* provided with ignition openings 16*b* and containing an ignition charge 16*c*. The ignition charge 16*c* is ignited by the hot propellant charge gases produced in the weapon after the rupture disk 14 has been destroyed and, in turn, provides hot gases for the ignition of the propellant charge 1 to its inner surface 1*a* via the ignition openings 16*b*.

To improve the ignition sensitivity of the propellant charge 1, the rim area or inner surface 1*a* of the propellant charge 1 surrounding and defining the ignition conduit 4 is conically narrowed in the aft direction. This achieves a better ignition of the propellant charge 1 by the hot gases generated by the ignition means 16, since the clouds of gas actually impact on the rim area or inner surface 1*a* and do not merely tangentially graze same.

In an advantageous embodiment of the invention, stepped sections 1*b* (FIG. 2) are additionally disposed in the conically narrowed rim area 1*a*. By means of these stepped sections 1*b* the ignition readiness of the propellant charge 1 is further increased, since the ignition gases exiting from the ignition openings 16*b* are caught in the annularly extending edges formed by the stepped sections 1*b* and thus have a better chance to ignite the propellant charge 1.

Figure 2:
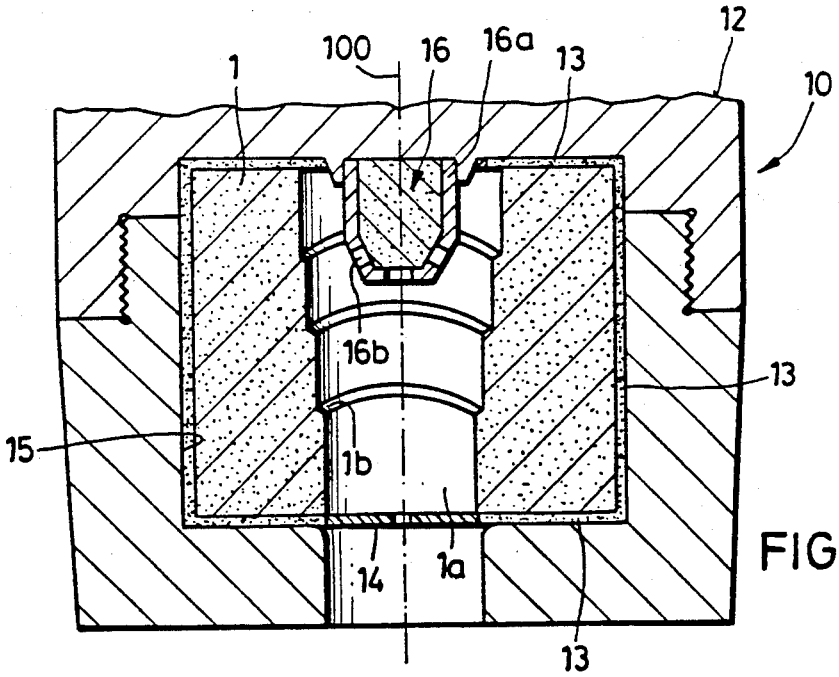
FIG. 2 shows the aft section of a shell in longitudinal section with a further exemplary embodiment of the invention.

In an advantageous improvement of the invention as shown in FIG. 2, at least some of the ignition openings 16*b* inside the housing 16*a* of the ignition means 16 are disposed at an angle relative to the longitudinal axis 100 of the propellant charge 1, namely in such a way that they are more or less aligned towards the rim area 1*a* of the propellant charge 1. This results in a further improvement of the ignition readiness of the propellant charge 1, since now the surface 1*a* is directly in the flow direction from the ignition openings 16*b*.

It is, of course, possible to combine the embodiments shown in FIG. 1 and FIG. 2 of the invention with the teachings disclosed in Federal Republic of Germany patent application DE P No. 34 37 250.4, i.e. to provide, for example, the rim area 1*a* formed in accordance with the invention additionally with a roughened structure or with an ignition-enhancing layer.

I claim:

1. In a propellant charge for the reduction of base eddying for a shell, with said propellant charge having a centrally disposed axially extending ignition conduit and being provided with an ignition means disposed adjacent the front end of said ignition conduit, for igniting said propellant charge; the improvement wherein the inner surface of said propellant charge which forms said ignition conduit of said propellant charge is conically narrowed in the aft direction.

2. A propellant charge in accordance with claim 1, wherein stepped sections are additionally disposed in said conically narrowed inner surface.

3. A propellant charge in accordance with claim 1, wherein said ignition means includes a housing provided with ignition openings and containing an ignition charge; and at least some of said ignition openings disposed in said housing of said ignition means are disposed at an angle relative to the longitudinal axis of said propellant charge so that they face said inner surface.

4. A propellant charge in accordance with claim 2, wherein said ignition means includes a housing provided with ignition openings and containing an ignition charge; and at least some of said ignition openings disposed in said housing of said ignition means are disposed at an angle relative to the longitudinal azis of said propellant charge so that they face said inner surface.

5. A propellant charge according to claim 1, wherein said ignition means includes a housing provided with ignition openings and containing an ignition charge which, when ignited, produces hot gases for igniting said propellant charge.

6. A propellant charge according to claim 5, wherein said ignition means is responsive to and ignited by hot gases produced during firing of a shell and reaching said ignition means via said ignition conduit.

7. In an arrangement for reducing the base drag of a projectile including a solid propellant charge disposed within a projectile adjacent its base and having an inner surface which defines an ignition conduit extending through said propellant charge along its longitudinal axis and communicates with a central opening in said base, and an ignition means for said propellant charge disposed adjacent the end of said ignition conduit opposite said base; the improvement wherein said inner surface of said propellant charge conically narrows in a direction toward said base of said projectile.

8. An arrangement as defined in claim 7, wherein said inner surface of said propellant charge is additionally provided with stepped sections.

9. An arrangement as defined in claim 8, wherein said ignition means includes a housing provided with ignition openings and containing an ignition charge.

10. An arrangement as defined in claim 9, wherein said ignition means is responsive to and ignited by hot gases produced during firing of said projectile and reaching said ignition means via said ignition conduit.

11. An arrangement as defined in claim 10, wherein at least some of said ignition openings enclose an acute angle with said longitudinal axis when viewed from said base.

* * * * *